US010902697B2

(12) United States Patent
Grubmueller, Jr.

(10) Patent No.: US 10,902,697 B2
(45) Date of Patent: Jan. 26, 2021

(54) ROULETTE APPARATUS

(71) Applicant: Walter Grubmueller, Jr., Vienna (AT)

(72) Inventor: Walter Grubmueller, Jr., Vienna (AT)

(73) Assignee: Walter Grubmueller, Jr., Vienna (AT)

( * ) Notice: Subject to any disclaimer, the term of this patent is extended or adjusted under 35 U.S.C. 154(b) by 0 days.

(21) Appl. No.: 16/331,647

(22) PCT Filed: Sep. 9, 2016

(86) PCT No.: PCT/EP2016/071335
§ 371 (c)(1),
(2) Date: Mar. 8, 2019

(87) PCT Pub. No.: WO2018/046093
PCT Pub. Date: Mar. 15, 2018

(65) Prior Publication Data

US 2019/0244469 A1 Aug. 8, 2019

(51) Int. Cl.
*A63F 9/24* (2006.01)
*G07F 17/32* (2006.01)
*A63F 5/00* (2006.01)

(52) U.S. Cl.
CPC ..... *G07F 17/322* (2013.01); *A63F 5/00* (2013.01); *A63F 5/0005* (2013.01); *G07F 17/323* (2013.01); *G07F 17/3213* (2013.01); *A63F 2009/2458* (2013.01)

(58) Field of Classification Search
CPC ..... G07F 17/322; G07F 17/3213; A63F 2009/2461; A63F 2009/2463; A63F 2009/2469; A63F 5/00; A63F 5/0005
See application file for complete search history.

(56) References Cited

U.S. PATENT DOCUMENTS 5,540,442 A * 7/1996 Orselli ..... A63F 5/00 273/142 E
7,946,912 B1 * 5/2011 Rennard ..... A63F 5/00 273/138.1

(Continued)

FOREIGN PATENT DOCUMENTS

AU 2016203602 A1 6/2016
KR 20150139885 A 12/2015

OTHER PUBLICATIONS

International Search Report dated Jun. 8, 2017, which issued in the corresponding PCT Patent Applicaiton No. PCT/EP2016/071335.

*Primary Examiner* — Lawrence S Galka
(74) *Attorney, Agent, or Firm* — Dickinson Wright PLLC

(57) ABSTRACT

The present inventions concerns a roulette apparatus (1) comprising at least one graphical roulette-display-system (10) and a mechanical wheel (20) having a plurality of pockets (21) adapted to receive a ball, wherein the mechanical wheel (20) and the at least one graphical roulette-display-system (10) is controlled by an electronic-control-system (30) and wherein the at least one graphical roulette-display-system (10) displays a field of numbers and/or symbols and the roulette apparatus (1) further comprising at least one wheel control unit (60) adapted to influence the rotation and/or movement of the mechanical wheel (20) according to the electronic-control-system (30) in order to bring the wheel into a position based on an information received from the electronic-control-system (30).

14 Claims, 2 Drawing Sheets

(56) References Cited

U.S. PATENT DOCUMENTS

| | | | | |
|---|---|---|---|---|
| 2005/0288089 | A1* | 12/2005 | Cammegh | A63F 5/00 463/17 |
| 2006/0287053 | A1* | 12/2006 | Yokota | A63F 5/00 463/17 |
| 2007/0060262 | A1* | 3/2007 | Kosaka | A63F 5/00 463/16 |
| 2008/0113717 | A1* | 5/2008 | Okada | A63F 5/00 463/17 |
| 2008/0211180 | A1* | 9/2008 | Lutnick | G07F 17/3286 273/142 C |
| 2010/0130280 | A1* | 5/2010 | Arezina | G07F 17/3206 463/20 |
| 2010/0279757 | A1 | 11/2010 | Glenn | |
| 2014/0187306 | A1* | 7/2014 | Nordahl | A63F 5/00 463/17 |
| 2015/0321082 | A1* | 11/2015 | Kawabata | G07F 17/3213 273/142 E |
| 2016/0344989 | A1* | 11/2016 | Izawa | H04N 9/3141 |

* cited by examiner

ROULETTE APPARATUS

BACKGROUND OF THE INVENTION

The present invention relates to a roulette apparatus comprising a graphical roulette-display-system and a mechanical wheel. The present invention therefore relates in particular to roulette apparatus comprising a graphical roulette-display-system and a mechanical wheel, accompanying physical modifications and control system.

Roulette and gaming apparatuses are well known in the art. A roulette gaming apparatus has provided entertainment and bets in casinos and other gaming establishments for many years.

Typically a circular roulette wheel is spun in either a clockwise or an anti-clockwise direction about its central axis. The wheel comprises a plurality of compartments to receive a ball. The compartments are typically numbered with numbers. The wheel displays therefore static content relating to game information, such as the winning numbers. A ball is released onto the surface of the wheel where it is randomly deflected before eventually coming to rest in one of the desired compartments, where a player bet on.

Since players bet on a compartment (pocket) or a group of compartments the ball is going to fall into by placing tokens or "chips" at appropriate locations on a betting table and e.g. a croupier may manually operate the wheel. These traditionally roulette game systems have been modified in different aspects, such as technical aspects and electronic technology.

In existing roulette apparatuses the wheel is surrounded by fixed (unchangeable) installed numbers and colors (typically red and black) and therefore the static game information relating to the winning numbers is printed on a surface indicating the position of the respective compartments of the roulette wheel when stopping in a gaming position after turning the wheel.

However, this system e.g. does not allow to modify the game and to provide physical modifications for the respective game variation, such as e.g. derivative games. It is therefore desirable to provide a multifarious roulette apparatus with different possibilities to modify and control the game. Moreover, the roulette gaming systems using modifiable winning numbers needs a set or high number of independent electronic display units such as a LCD-display-blocks for each winning number. These are after their installation fixed in the size and such a solution needs a complex control system to play the roulette game in a trustworthy manner. Moreover, such display screens are not available to put a mechanical wheel inside the screen of such a display system. Since a display screen with a cutout hole in the center to put in a wheel is not available, it is difficult to implement game roulette apparatuses allowing physical and/or graphical modifications of the display and display content. Since it is advantageous for the game and the display of game relevant content, an uninterrupted display is wanted. By uninterrupted display a display without display rims between displayed segments is meant. With an uninterrupted display it is possible to animate and display the dynamic changeable content in a fluid way, even if the content changes its position from one segment of the display to another segment.

One aspect of the present invention is to enable the implementation of derivative games that are a modification of the classic version of roulette, for instance a game wherein a number is knocked out after each spin, causing the bet odds to change, and the display to therefore change the count of numbers.

Another aspect is the implementation of the physical needs in order to allow the display of dynamic content even though the winning number is already drawn by a RNG (random number generator).

Therefore an object of the present invention is to overcome the abovementioned disadvantages and to provide a modifiable and multifarious roulette-system.

According to an aspect of the present invention, a standard roulette bowl, wheel and table is modified to incorporate a graphical roulette-display-system, accompanying physical modifications and control system as well as a control system for the mechanical wheel. The new gaming system combines elements of the well-known game of roulette with enhanced functionality and reliability.

To overcome the above said problems a roulette apparatus is provided comprising at least one graphical roulette-display-system and a mechanical wheel. The mechanical wheel having a plurality of pockets adapted to receive a ball, wherein the mechanical wheel and the at least one graphical roulette-display-system is controlled by an electronic-control-system. The at least one graphical roulette-display-system displays changeable dynamic content like information and graphics in particular such changeable content which can be changed in regard to the size, in regard to the respective position, in regard to information content and/or in regard to static and dynamic changeable content which gives the impression of a turning ring section around or on top of the mechanical wheel. The roulette-display-system for example displays a field of numbers and/or symbols and/or graphics which are displayed on the mechanical wheel and/or roulette bowl and/or payout table and/or roulette table on at least a display section around and directly adjacent to the wheel. This means that the graphical dynamic content can be varied from one state to another state but in such a manner that the information corresponds to e.g. a compartment or a pocket of the mechanical wheel. Moreover, the roulette-display-system may be used to display graphics and information related to the game play, ads, branding information, rules, or any other content capable of display thereon. The kind of display does not limit the type of content to be displayed, nor when it is displayed. The roulette apparatus further comprises at least one wheel control unit adapted to influence the rotation and/or movement of the mechanical wheel according to the electronic-control-system in order to bring the wheel into a position based on information received from the electronic-control-system.

According to a preferred embodiment of the present invention a roulette apparatus is provided wherein the mechanical wheel displays static content not relating to game information e.g. design elements like symbols or graphics which add no game relevant information or even design elements to distinguish between different segments of the mechanical wheel. Nevertheless the mechanical wheel can display static content like ornaments and decorating graphics.

In another advantageous embodiment a roulette apparatus is provided, wherein the mechanical wheel is designed to change the number N of pockets of the plurality of pockets. Wherein a standard roulette wheel has in total 37 or 38 pockets it is normally not possible to change this number N of pockets. To play derivates of the normal roulette game it is advantageous to change the number of pockets and/or the information displayed on the game components like mechanical wheel, roulette bowl, payout table and/or roulette table. Therefore the number N of pockets on the mechanical wheel is changeable. This is achieved by displaying the pockets by an image displayed by the graphical roulette display system and/or by making the boundaries between the pockets moveable. This means that the size of one or all the pockets can be appropriately adapted to the numbers of needed pockets for the respective game. For example the total area where the pockets are located could be divided in a plurality of webs. According to the desired number of pockets some webs are moved to form the boundaries in circumferential direction of the pockets. The webs which were not moved form e.g. the bottom of the pockets.

According to an advantageous embodiment of the present invention the plurality of pockets has mechanical boundaries to prevent the ball leaving a pocket of the plurality of pockets receiving the ball and/or the plurality of pockets is represented by a digital image displayed by the at least one graphical roulette-display-system. The boundaries are formed for example by moveable webs or moveable means forming the physical boundaries between two adjacent pockets. Nevertheless it is also possible to have no physical boundaries between the pockets when the pockets are only displayed by the roulette-display-system. To stop the ball from moving around it is possible to use special surfaces like magnetic surfaces or adhesive surface or surfaces with means to stop the ball from moving when it has reached a specific speed. For example the magnetic surface could be electrically triggered when the ball has a certain speed or has already stopped to prevent further movement of the ball or a surface with a plurality of depressions to receive the ball, wherein the number of depressions is higher than the number of pockets and the ball can leave the depression when it is fast enough.

Furthermore in an advantageous embodiment the at least one graphical roulette-display-system comprises at least one information display to display changeable dynamic content by means of a display device, wherein the changeable dynamic content relates to game information provided by the electronic-control-system.

In a preferred embodiment the display device is at least a video projector and/or an electronic display like OLED, LCD or e-ink display. A video projector in the sense of the present invention is understood as a light projecting device or image projector that receives a signal e.g. a video signal and projects the corresponding data image on a projection screen using an optical lens system. The video projector is arranged above or below a screen or in a position with a lens and/or mirror system to display the relevant image content on the desired area on or around the wheel. In case of the projector is arranged below, under or behind the screen the screen preferably has a certain transparency or is fully transparent with a layer capable to display the light signal coming from the beamer. The screen could be the mechanical wheel and/or the roulette bowl and/or the payout table and/or the roulette table in particular an annular region or section around the wheel. For the projection according to the invention more components like optics, lenses, apertures and mirrors can advantageously be used. It is possible that the graphical roulette-display-device has more than one display device, wherein a display device is a projector and another is an electronic display. For example to display the information on the mechanical wheel one projector could be used which projects symbols or number on the outer rim area of the wheel as well as an image of the pockets or a plurality of electronic displays could be used to display symbols or numbers adjacent to each pocket.

To display a sharply demarcated image on a circular screen it is advantageous for an embodiment, when the projector projects an annular or circular image on and/or around the mechanical wheel or another game relevant component like the roulette bowl. This could be implemented by the use of apertures and/or templates for the projector.

Furthermore it is advantageous for an embodiment when the electronic-control-system comprises a wheel controller controlling the mechanical wheel and a display controller controlling the at least one graphical roulette-display-system.

In a preferred embodiment the wheel controller comprises a speed sensor to determine the speed and/or the number of revolutions of the mechanical wheel, a ball sensor to determine the position of the ball at least when the ball is in one pocket of the plurality of pockets, a game controller adapted to determine a winning number by a random number generator and/or a width of each pocket of the plurality of pockets and/or winning and losing bets, and a label controller adapted to determine the position of the winning number on the rim of the mechanical wheel.

Wheel controller, display controller and wheel control unit are connected and coupled electronically to exchange data in an advantageous embodiment. Display controller and wheel control unit receive data from the wheel controller. The wheel controller determines game relevant information and transmits it to the wheel controller which steers the wheel by accelerating or slowing down the wheel to bring the ball and/or the wheel receiving the ball in a desired position. The wheel controller transmits this information also to the display controller. The display controller than can change the presently displayed information or graphics on the game components like mechanical wheel, roulette bowl, payout table and/or roulette table according to the received information. For example the wheel controller determines the winning number and then submits this information to the wheel control unit which starts to slow down the mechanical wheel. Then the wheel controller determines the current position of the ball and the speed of the mechanical wheel. When the ball has reached a certain position the wheel controller sends information to the wheel control unit to stop. At the same time information about winning number, ball position and wheel speed are sent from the wheel controller to the display controller. With this information the graphics displayed by the roulette-display-system which is controlled by the display controller the graphics or their orientation and position can be dynamically changed so that position of the displayed winning number matches the position of the ball on the mechanical wheel. As the position of the ball could be between to pockets or near to a pocket boarder the display controller also has to control the roulette-display-system in a manner to make it clear that the ball is in the winning numbers pocket. This can be achieved by dynamically rotating the displayed graphics and/or dynamically changing the displayed content. By sending the speed of the wheel and the position of the ball to the display controller, it can be made sure to stop the moving of the displayed graphics before, after or at the moment the wheel stops so that the graphics are aligned to the wheel in a certain manner.

Another aspect of the invention concerns a method of using a roulette apparatus as described above, said method including the steps of:

Capturing physical sizes like velocity and/or number of revolutions of the mechanical wheel and/or the position of the ball by sensors like speed sensor and/or revolution sensor and/or ball sensor.

Using of a central control and/or wheel controller to determine steering information for mechanical wheel and/or roulette-display-systems based on the physical sizes.

Displaying game relevant Information by the roulette-display-systems and optionally received information from the central control and/or the wheel controller.

Determining a winning number by a random number generator.

Determining steering information for steering the mechanical wheel and the roulette-display-system by processing the available information, to steer the mechanical wheel to a certain position and at least a graphic and/or symbol and/or changeable dynamic content displayed by the roulette-display-system in a certain position and/or alignment to the mechanical wheel.

Steering the mechanical wheel in a certain position by slowing down and/or accelerating the mechanical wheel.

Steering the roulette-display-system to show the dynamically changeable content in a certain alignment to the mechanical wheel and/or the ball on the mechanical wheel.

In a preferred embodiment a method of using the described roulette table contains the following steps (not necessarily in the given order):

a. determining the speed and/or the number of revolutions of the mechanical wheel by means of the speed sensor;
b. determining the winning number by means of the random number generator of the game controller;
c. determining the position of the ball by means of the ball sensor at least at the position where the ball has stopped in relation to the wheel or the compartment;
d. determining the intended final position of a label to be displayed representing the winning number displayed by the at least one graphical roulette-display-system by means of the label controller;
e. bringing the position of the ball with the position of the label representing the winning number in correspondent adjacent positions in particular by slowing down the mechanical wheel by means of the wheel control unit until it stops and the ball is in a section of the mechanical wheel corresponding to the label representing the winning number displayed by the at least one graphical roulette-display-system;
f. optionally determining the width of each pocket of the plurality of pockets by means of the game controller;
g. optionally determining winning and losing bets by means of the game controller;
h. optionally changing the displayed content displayed by the at least one graphical roulette-display-system;
i. repeating the steps until a predetermined game cycle is reached.

Another aspect of the invention concerns a method of using the above described roulette apparatus, said method including the steps of (not necessarily in the given order):

a. selecting a winning number by a random number generator and associating the winning number to a number of a field of numbers displayed by the at least one graphical roulette-display-system;
b. determining winning and losing bets by means of a game controller;
c. changing the displayed content displayed by at least one graphical roulette-display-system by displaying the winning and losing bets on a payout table;
d. changing the displayed content displayed by the at least one graphical roulette-display-system by changing the field of numbers displayed by the at least one graphical roulette-display-system;
e. removing or replacing the winning number with a randomly selected or predetermined number of the numbers remaining in the field of numbers displayed by the at least one graphical roulette-display-system or adjust a width of a section in a circumferential direction of the remaining numbers in the field of numbers displayed by the at least one graphical roulette-display-system;
f. recalculating the odds and/or the payout of each possible bet; and
g. changing the displayed content displayed by the at least one graphical roulette-display-system by displaying the odds and/or the payout of each possible bet and each possible bet on the payout table;
h. changing the displayed content displayed by the at least one graphical roulette-display-system to highlight an event occurring during a step;
i. repeating the steps until a predetermined game cycle is reached.

As the invention may be used to facilitate alternative or derivative forms of roulette, some other physical modifications to the roulette game are part of this invention. This is necessary in order to fully enable the breadth of modifications permitted by the graphical display system and the mechanical wheel, as the graphics displayed on the graphical display system often need a physical analogue as part of the game mechanics. Therefore a further aspect of the invention concerns the roulette wheel. The roulette wheel may be provided with ball pockets, wherein the size of the ball pockets is adjustable and changeable during a game.

Another commercial aspect of this invention concerns a business or commercial method which is connected to the aforesaid roulette apparatus. Therefore, the invention also concerns a business method using an apparatus as defined in anyone of the apparatus claims. A business or commercial method is therefore provided wherein the mathematic probability to match a winning number increases within the games cycles in particular wherein the probability depends on the remaining numbers N of not removed numbers of the field of numbers and will calculates as 1/N.

For example, starting with a roulette wheel with 37 numbers in the field of numbers will result in a winning probability of 1/37. After a first game cycle, the winning number will be removed, and only 36 numbers in the field of numbers remain. After n game cycles only 37-n numbers in the field of numbers remain and the chance is increased to 1/(37-n) etc.

However, it is remarked that the winnings which can be obtained when the winning number corresponds to the betting number, is simultaneously decreased.

DETAILED DESCRIPTION OF THE INVENTION

A more complete appreciation of the invention and many of the attendant advantages thereof will be readily obtained as the same becomes better understood by reference to the following detailed description when considered in connection with the accompanying drawings, wherein.

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
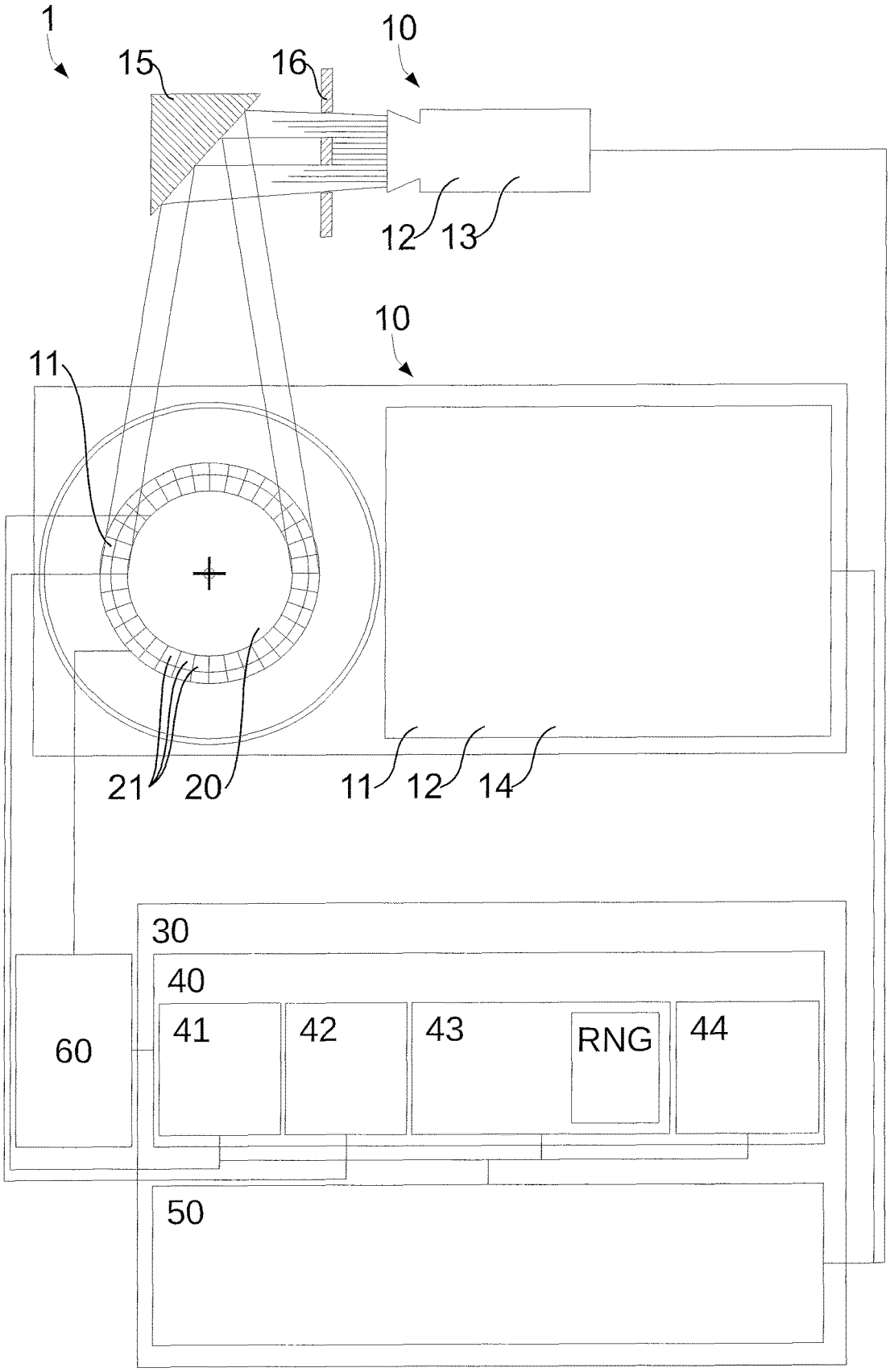
FIG. 1 is a schematic view of a conception of a roulette apparatus according to one explanatory embodiment of the invention.

FIG. 1 is a schematic view of a conception of a roulette apparatus 1 according to one explanatory embodiment of the invention. The roulette apparatus 1 comprising a graphical roulette-display-system 10 with two information displays or screens 11 is seen from above. One of the information displays 11 is a display device 12, more particularly an electronic display 14 like OLED, LCD, LED display, e-ink display or similar. The displayed information on the electronic display 14 displays a payout or betting table, where one or more players can place their bet or bets in a physical and/or digital manner by e.g. placing tokens on the according sections displayed by the electronic display 14. The electronic display 14 may also display game relevant information like the probabilities of each bet and also more information like ads. The other information display 11 is in this example a screen or information display 11 in the outer rim area of the mechanical wheel 20. The screen or information display 11 is for example a white area to display the image projected by the video projector 13. The video projector in this example is installed above the roulette apparatus and the image is filtered with an aperture 16 and then redirected by a mirror 15. The mirror 15 and the aperture 16 could be moveable to sharpen or redirect the image on the roulette apparatus 1. The projector could also be beneath the roulette apparatus 1 and project an image to the bottom side of the mechanical wheel 20. The screen or information display 11 on the outer rim of the roulette wheel is therefore not completely transparent, so that the projected image is visible for the players. The video projector 13 could also project an image without using mirror 15 or aperture 16 or by using several or different optical means. Instead of the video projector 13 for displaying information on the wheel an electronic display or more than one electronic display could alternatively also be used. For displaying information in the area of the electronic screen 14 also a video projector could be used. The roulette apparatus 1 of FIG. 1 also contains en electronic-control-system 30 and a wheel control unit 60. The electronic-control-system 30 is steering the mechanical wheel 20 by the wheel control unit 60 to bring the mechanical wheel and/or the ball on the mechanical wheel in a certain passion. For the steering of the mechanical wheel 20 the control unit 60 comprises a motor or a drive for accelerating or a brake for slowing down the mechanical wheel. For steering the mechanical wheel 20 the electronic-control-system 30 comprises a wheel controller 40 which comprises a speed sensor 41 to determine the speed and/or the number of revolutions of the mechanical wheel 20, a ball sensor 42 to determine the position of the ball at least when the ball is in one pocket of the plurality of pockets 21, a game controller 43 adapted to determine a winning number by a random number generator RNG and winning and losing bets, and a label controller 44 adapted to determine the final and intended position of the winning number on the outer rim of the mechanical wheel 20. Furthermore the electronic-control-system 30 comprises a display controller 50 for controlling the roulette-display-system 10 with its display devices 12.

The different parts of the electronic-control-system 30 are electronically connected to exchange relevant data, the wheel controller 40 is connected to the wheel control unit 60 for steering the mechanical wheel, and the display controller 50 is connected to the display devices 12 for transmitting the respective images for the display devices 12 to display.

The display devices 12 each can display changeable dynamic content relating to game information. A display device 12 can be digitally changed at any time, unlike a static printed graphic. As display device 12 any suitable technology such as LCD, LED, OLED, projection, deflection, laser, or any other method of dynamically displaying an image can be used.

There may be multiple independent or common display devices 12, information displays 11 or roulette-display-systems 10 in the preferred embodiments and the physical positioning of the display devices 12 and/or the information displays 11 and/or roulette-display-systems 10 may extend to the roulette wheel 20 or the roulette table or any auxiliary positioning which is to be considered as part of the game in a contextual sense without any implication of physical proximity, including the case where the display may be positioned remotely. A preferred positioning is on the roulette bowl which should be understood to mean as part of the "roulette apparatus", bowl, cone, ball pockets, ball track, wheel head and any other parts of the roulette installation.

An alternative possible positioning is in the immediate vicinity of the roulette bowl or roulette wheel 20. This does not state the number or combination of these display devices 12 and any permutation is to be considered as part of the invention. The information displays 11 may operate independently from one another meaning the content can be different amongst the information displays 11, in all senses of the meaning, i.e. both at a point in time and the manner of change over time.

The information display 11 of the roulette-display-system 10 could be used to dynamically display the game numbers that might change during the game, dynamic ads, branding, game information, game rules, or any other visual information. There are no limits to the type of content displayed, neither to when the content is displayed as it may be displayed before, during or after a game of roulette without any implied time restriction.

The information display 11 is connected to an electronic-control-system 30 driving the information display by the display controller 50, which may be embodied as a computer, SoC, embedded circuit, display controller, standalone graphic card, or any other device capable of driving the display.

The electronic-control-system 30 more specifically the display controller 50 driving the information display 11 of the graphical roulette-display-system 10 is connected to an input source via an input interface from where it receives instructions for what to display, or what content. Some non-limiting examples of instruction and content sources are: set of preset graphics, graphics delivered via network either locally or remotely (e.g. LAN, internet, DSL, cellular, satellite, etc.), back office administrator panel, betting shop terminal, portable media, programmatically rendered graphics, advertising network, or any other data delivery method. The roulette-display-system 10 may have multiple operators simultaneously and there may be some logic or algorithm as part of the electronic-control-system 30 that can autonomously mediate between types of content.

The image displayed on the information display 11 via the display controller 50 may change at anytime. The type of information to be displayed on the information display 11 nor the source thereof are limited, the aforementioned examples are provided for purposes of illustration and should not be considered limiting.

The information display 11 may be protected to withstand physical wear and tear in case the technical requirements warrant it. Some possible examples of a protective cover include: a transparent covering panel (such as glass, perspex, acrylic glass/plexiglass, any form of plastic, sapphire crystal, mineral glass), a wear resistant coating, or any other coating or surface designed to be applied to, or near, the display with the purpose of shielding it from damage and extending its useful lifetime. Protecting the display may only apply in the case where the display is likely to suffer from physical wear, which may not be the case, for instance if the information display 11 is implemented using a projection or deflection method. The protection may serve multiple purposes and this should be considered as part of the invention, for instance in the event where the display is positioned below the ball track, the ball track may be implemented as a transparent sapphire crystal glass which serves the dual purpose of protecting the underlying screen as well as being the mechanical ball track upon which the ball spins.

The implementation of the mechanical wheel 20 may be physically modified in the embodiment. For example the traditionally fixed pockets, which usually match the count of numbers on the wheel and accordingly provide a physical manifestation of the implied winning odds as displayed by the numbers on the roulette wheel, may be modified to an implementation capable of dynamically adjusting the width of the pockets—this is to be understood as the area wherein when a ball were to land would be considered as attributed to that number, the implementation need not necessarily be a single ball pocket—usually in unison with changes on the graphical display, although not necessarily.

Therefore a roulette apparatus with a roulette wheel may be provided with ball pockets 21, wherein the size of the ball pockets 21 are adjustable and wherein the roulette wheel 20 is provided with adjustable and/or positionable ball deflectors which may change position during the game.

For instance in a modification of the classic game of roulette, where at the end of each spin the winning number is to be removed, with the exception of the house numbers such as the 0 or 00, the information display 11 would be used to display numbers with a varying width allotment, and the ball pockets 21 would need to adjust their allotted width accordingly in order to facilitate and mirror in the physical world, the probability of the ball landing in a certain pocket in accordance with that what is displayed on the display. The physical modifications may require as part of the implementation the use of electromotors, servomechanism, actuators or any such similar devices, which are driven by the display control system. Moreover, the apparatus is provided with a number of preset graphics, an ad network, an administrative panel (operated by a user or automatically by a control unit), portable media input unit and/or a backoffice unit. Nevertheless the size of the pockets could also be changed by changing the image when the image also displays the pockets.

Furthermore the apparatus 1 is provided with sensors arranged in a sensor array to detect physical characteristics and/or a status and/or a position or other measurable properties of the mechanical wheel 20.

By extension of the above-mentioned modifications to the ball pockets 21, other aspects of the roulette bowl may be modified to facilitate any form or derivative form of roulette that the information display 11 may enable. A nonlimiting example thereof is the dynamic positioning of the ball deflectors, and other potential modifications are to be considered as part of the invention. While particular embodiments have been chosen to illustrate the invention, it will be understood by those skilled in the art that various changes and modifications can be made therein without departing from the scope of the invention as defined in the appended claims.

Figure 2:
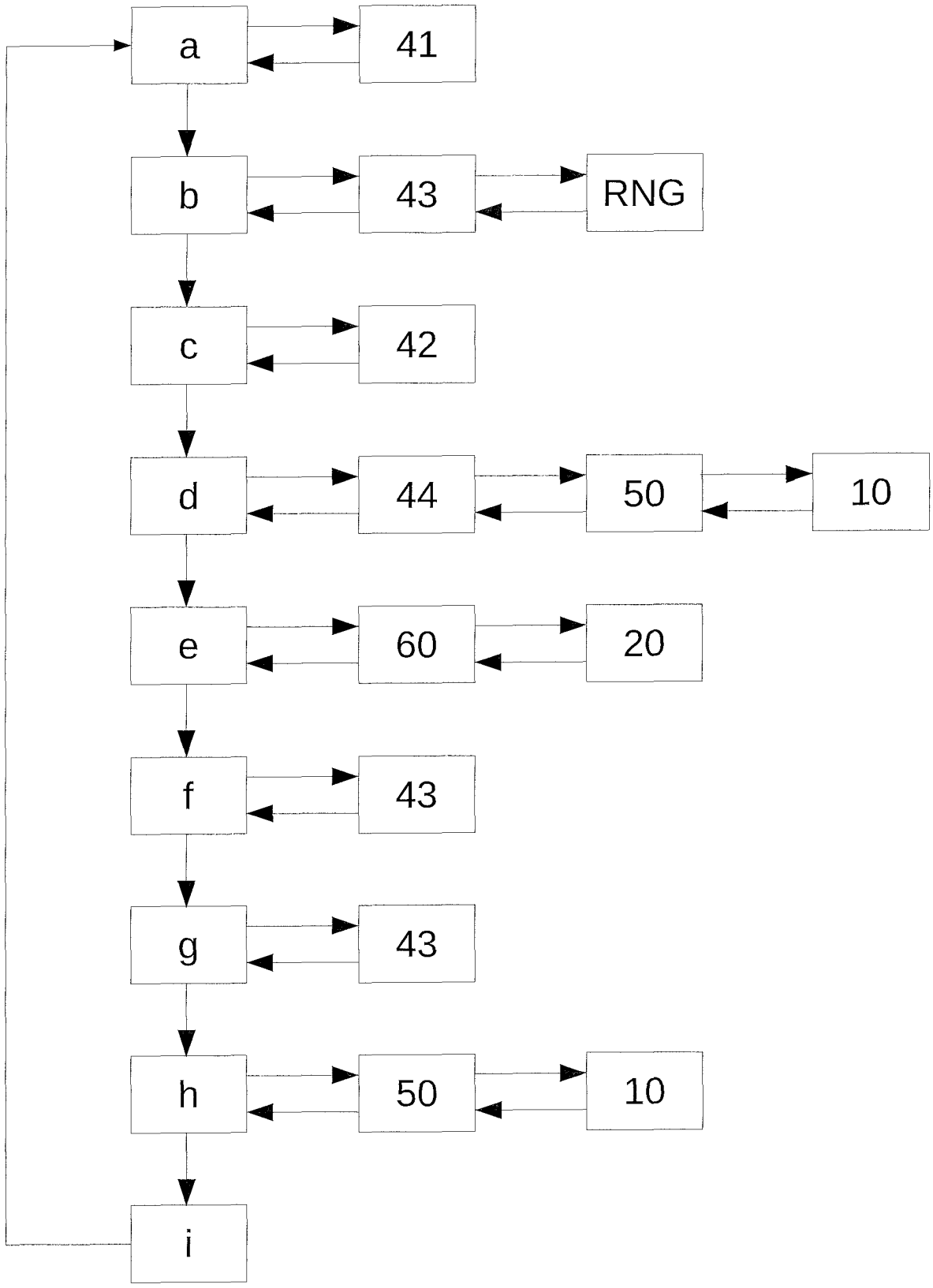
FIG. 2 is a schematic view of a method to use a roulette apparatus according to one explanatory embodiment of the invention.

FIG. 2 shows a method using a roulette apparatus 1. The steps could also appear in a different order to facilitate the invention. In the beginning of a game the standard roulette layout is shown on the mechanical wheel 20 by the roulette-display-system 10. When the game starts in step a) the speed and/or the revolution of the mechanical wheel 20 is determined by means of a speed sensor 41. The speed sensor transmits for example the speed to the electronic-control-system 30 which then calculates the number of revolution or the position of a reference point. This is done as long as the mechanical wheel 20 is turning. In step b) a winning number is determined by the game controller 43 more specifically by a random number generator RNG of the game controller 43. Then the mechanical wheel slows down by itself or by means of the wheel control unit 60. Step c) is to determine the position of the ball by means of a ball sensor 42. The sensor could be a capacitive or inductive sensor array beneath or adjacent the outer rim of the mechanical wheel 20 or also a tracking system using a camera. When the ball position in the outer rim section or in the pocket section of the mechanical wheel 20 is detected step d) matches the symbol displayed by the roulette-display-system 10 to the pocket or to the position of the ball by means of the label controller 44, the display controller 50 and the roulette-display-system 10 by adjusting the spinning velocity of the image to the spinning velocity of the mechanical wheel 20. This can also take place in parallel to step e) which slows down the mechanical wheel 20 by the wheel control unit 60 by using e.g. a brake.

When the winning number is announced bets are payout out and/or taken from the table. The winning number than gets removed from the numbers or symbols displayed by the roulette-display-system 10 by changing and adapting the displayed image. If the pocket of the winning number gets also removed all other pockets need to be adjusted in their width. The appropriate width of each pocket is determined in step f) by the game controller 43. Alternatively the display of the winning number is exchanged by a predetermined or random different number or symbol. In this case it is not necessary to change the width of the pockets. In parallel it can be determined by step g which bets won and which bets have lost in this game round. This can be also be shown by changing the image displayed by the roulette-display-system 10 on the game table or the payout table. Step h takes place in parallel or after all calculations are done. In step h the displayed content changes dynamically to the new content e.g. new pockets, numbers, winning and losing chances. Then the next round of the game starts. This repeats for a predetermined number of times or also for a random number (step i).

The invention claimed is:

1. A roulette apparatus (1) comprising at least one graphical roulette-display-system (10) and a mechanical wheel (20) having a plurality of pockets (21) adapted to receive a ball, wherein the mechanical wheel (20) and the at least one graphical roulette-display-system (10) is controlled by an electronic-control-system (30) and wherein the at least one graphical roulette-display-system (10) displays a field of numbers and/or symbols and the roulette apparatus (1) further comprising at least one wheel control unit (60) adapted to influence the rotation and/or movement of the mechanical wheel (20) according to the electronic-control-system (30) in order to bring the wheel into a position based on an information received from the electronic-control-system (30);

wherein the mechanical wheel (20) is designed to change the number N of pockets of the plurality of pockets (21).

2. A roulette apparatus (1) according to claim 1, wherein the mechanical wheel (20) displays no static content relating to game information.

3. A roulette apparatus (1) according to claim 1, wherein the plurality of pockets (21) has mechanical boundaries to prevent the ball leaving a pocket of the plurality of pockets (21) receiving the ball and/or the plurality of pockets (21) is represented by a digital image displayed by the at least one graphical roulette-display-system (10).

4. A roulette apparatus (1) according to claim 1, wherein the at least one graphical roulette-display-system (10) comprises at least one information display (11) to display changeable dynamic content by means of a display device (12), wherein the changeable dynamic content relates to game information provided by the electronic-control-system (30).

5. A roulette apparatus (1) according to claim 4, wherein the display device is at least a video projector (13) and/or an electronic display (14).

6. A roulette apparatus (1) according to claim 5, wherein the video projector (13) projects an annular image on and/or around the mechanical wheel (20).

7. A roulette apparatus (1) according to claim 1, wherein the electronic-control-system (30) comprises a wheel controller (40) controlling the mechanical wheel (20) by means of a wheel control unit (60) and a display controller (50) controlling the at least one graphical roulette-display-system (10).

8. A roulette apparatus (1) according to claim 7, wherein the wheel controller (40) comprises a speed sensor (41) to determine the speed and/or the number of revolutions of the mechanical wheel (20), a ball sensor (42) to determine the position of the ball at least when the ball is in one pocket of the plurality of pockets (21), a game controller (43) adapted to determine a winning number by a random number generator (RNG) and/or a width of each pocket of the plurality of pockets (21) and/or winning and losing bets, and a label controller (44) adapted to determine the position of the winning number on the rim of the mechanical wheel (20).

9. A roulette apparatus (1) according to claim 7, wherein wheel controller (40), display controller (50) and wheel control unit (60) are connected electronically to exchange data and display controller (50) and wheel control unit (60) receive data from the wheel controller(40).

10. A roulette apparatus (1) comprising at least one graphical roulette-display-system (10) and a mechanical wheel (20) having a plurality of pockets (21) adapted to receive a ball, wherein the mechanical wheel (20) and the at least one graphical roulette-display-system (10) is controlled by an electronic-control-system (30) and wherein the at least one graphical roulette-display-system (10) displays a field of numbers and/or symbols and the roulette apparatus (1) further comprising at least one wheel control unit (60) adapted to influence the rotation and/or movement of the mechanical wheel (20) according to the electronic-control-system (30) in order to bring the wheel into a position based on an information received from the electronic-control-system (30);

wherein the electronic-control-system (30) comprises a wheel controller (40) controlling the mechanical wheel (20) by means of a wheel control unit (60) and a display controller (50) controlling the at least one graphical roulette-display-system (10); and wherein the wheel controller (40) comprises a speed sensor (41) to determine the speed and/or the number of revolutions of the mechanical wheel (20), a ball sensor (42) to determine the position of the ball at least when the ball is in one pocket of the plurality of pockets (21), a game controller (43) adapted to determine a winning number by a random number generator (RNG) and/or a width of each pocket of the plurality of pockets (21) and/or winning and losing bets, and a label controller (44) adapted to determine the position of the winning number on the rim of the mechanical wheel (20); and a method of using the roulette apparatus (1) including the steps of:

a. determining the speed and/or the number of revolutions of the mechanical wheel (20) by means of the speed sensor (41);

b. determining the winning number by means of the random number generator (RNG) of the game controller (43);

c. determining the position of the ball by means of the ball sensor (42);

d. determining the position of a label representing the winning number displayed by the at least one graphical roulette-display-system (10) by means of the label controller (44);

e. slowing down the mechanical wheel (20) by means of the wheel control unit (60) until it stops and the ball is in a section of the mechanical wheel (20) corresponding to the label representing the winning number displayed by the at least one graphical roulette-display-system (10);

f. optionally determining the width of each pocket of the plurality of pockets (21) by means of the game controller (43);

g. determining winning and losing bets by means of the game controller (43);

h. changing the displayed content displayed by the at least one graphical roulette-display-system (10) by means of the display controller (50); and i. repeating the steps until a predetermined game cycle is reached.

11. A roulette apparatus (1) comprising at least one graphical roulette-display-system (10) and a mechanical wheel (20) having a plurality of pockets (21) adapted to receive a ball, wherein the mechanical wheel (20) and the at least one graphical roulette-display-system (10) is controlled by an electronic-control-system (30) and wherein the at least one graphical roulette-display-system (10) displays a field of numbers and/or symbols and the roulette apparatus (1) further comprising at least one wheel control unit (60) adapted to influence the rotation and/or movement of the mechanical wheel (20) according to the electronic-control-system (30) in order to bring the wheel into a position based on an information received from the electronic-control-system (30);

wherein the electronic-control-system (30) comprises a wheel controller (40) controlling the mechanical wheel (20) by means of a wheel control unit (60) and a display controller (50) controlling the at least one graphical roulette-display-system (10); and wherein the wheel controller (40) comprises a speed sensor (41) to determine the speed and/or the number of revolutions of the mechanical wheel (20), a ball sensor (42) to determine the position of the ball at least when the ball is in one pocket of the plurality of pockets (21), a game controller (43) adapted to determine a winning number by a random number generator (RNG) and/or a width of each pocket of the plurality of pockets (21) and/or winning and losing bets, and a label controller (44) adapted to determine the position of the winning number on the rim of the mechanical wheel (20); and a method of using the roulette apparatus (1) including the steps of:

a. selecting a winning number by a random number generator (RNG) and associating the winning number to a number of a field of numbers displayed by the at least one graphical roulette-display-system (10);

b. determining winning and losing bets by means of a game con-trailer (43);

c. changing the displayed content displayed by at least one graphical roulette-display-system (10) by displaying the winning and losing bets on a payout table;

d. changing the displayed content displayed by the at least one graphical roulette-display-system (10) by changing the field of numbers displayed by the at least one graphical roulette-display-system (10);

e. removing or replacing the winning number with a randomly selected or predetermined number of the numbers remaining in the field of numbers displayed by the at least one graphical roulette-display-system (10) or adjust a width of a section in a circumferential direction of the remaining numbers in the field of numbers displayed by the at least one graphical roulette-display-system (10);

f. recalculating the odds and/or the payout of each possible bet;

g. changing the displayed content displayed by the at least one graphical roulette-display-system (10) by displaying the odds and/or the payout of each possible bet and each possible bet on the payout table;

h. changing the displayed content displayed by the at least one graphical roulette-display-system (10) to highlight an event occurring during a step; and i. repeating the steps until a predetermined game cycle is reached.

12. Business or commercial method of providing roulette games using a roulette apparatus according to a roulette apparatus (1) comprising at least one graphical roulette-display-system (10) and a mechanical wheel (20) having a plurality of pockets (21) adapted to receive a ball, wherein the mechanical wheel (20) and the at least one graphical roulette-display-system (10) is controlled by an electronic-control-system (30) and wherein the at least one graphical roulette-display-system (10) displays a field of numbers and/or symbols and the roulette apparatus (1) further comprising at least one wheel control unit (60) adapted to influence the rotation and/or movement of the mechanical wheel (20) according to the electronic-control-system (30) in order to bring the wheel into a position based on an information received from the electronic-control-system (30);

wherein a step to remove or replace the winning number with a randomly selected or predetermined number of the numbers remaining in the field of numbers displayed by the at least one graphical roulette-display-system and/or adjust a width of a section in a circumferential direction of the remaining numbers in the field of numbers displayed by the at least one graphical roulette-display-system and a recalculation of the odds and/or the payout of each possible bet is performed.

13. Business or commercial method according to claim 12, wherein the mathematic probability to match a winning number increases within the games cycles.

14. Business or commercial method according to claim 13, wherein the winning probability depends on the remaining numbers N of numbers in the field of numbers and will calculates as 1/N.

* * * * *